United States Patent [19]

Goldstone et al.

[11] 4,301,763

[45] Nov. 24, 1981

[54] POWDER DISPENSING APPARATUS

[75] Inventors: Edward G. Goldstone, Huntington Woods; Clayton E. Peal, Rochester, both of Mich.

[73] Assignee: Dayco Corporation, Dayton, Ohio

[21] Appl. No.: 177,699

[22] Filed: Aug. 13, 1980

[51] Int. Cl.[3] ..... B05C 19/00

[52] U.S. Cl. ..... 118/308; 118/312; 427/180; 427/195; 222/415

[58] Field of Search ..... 427/180, 195; 118/308, 118/312; 222/415, 478, 485, 560, 528; 239/689, 450, 546

[56] References Cited

U.S. PATENT DOCUMENTS

| | | | |
|---|---|---|---|
| 888,963 | 5/1908 | Dahlund | 222/560 |
| 1,456,083 | 5/1923 | Weiss | 427/180 X |
| 1,716,384 | 6/1929 | Pettee | 427/181 |
| 2,441,492 | 5/1948 | Koon et al. | 427/195 X |
| 2,593,420 | 4/1952 | Diehl | 239/546 X |
| 2,940,424 | 6/1960 | Rose et al. | 222/415 |
| 3,894,510 | 7/1975 | Eto | 118/308 |
| 4,046,104 | 9/1977 | Stuhlman | 118/324 |

*Primary Examiner*—Shrive P. Beck

*Attorney, Agent, or Firm*—Charles E. Bricker

[57] ABSTRACT

An apparatus for and method of dispensing a powder-like material by gravity with substantial uniformity and a minimum contamination of the immediate environment is provided wherein the apparatus comprises a substantially horizontally disposed tubular body having opening means through a bottom portion thereof and conveying means moveable within the body for moving the powder-like material over the opening means enabling gravity flow therethrough and wherein the conveying means comprises a flexible conveying device which is moveable through the tubular body and a plurality of flights fastened in spaced relation on the device for engaging and moving the powder-like material along the tubular body and over the opening means.

9 Claims, 10 Drawing Figures

POWDER DISPENSING APPARATUS

BACKGROUND OF THE INVENTION

1. Field of the Invention

This invention relates to an apparatus for and method of dispensing a powder-like material by gravity flow with substantial uniformity and minimum contamination of the immediate environment.

2. Prior Art Statement

There are numerous applications in industry where it is necessary to dispense a powder-like material or powder on a workpiece to enable further processing of such workpiece. Particularly in the art of making fibrous blankets or webs comprised of a workpiece defined as a controlled thickness layer of disconnected randomly disposed fibers or fiber lengths which are to be bonded together by an adhesive material, such as a resin provided in powder form, it is especially important to dispense the resin with as much uniformity of resin distribution as possible and with minimum contamination of the immediate vicinity or environment. Fibrous blankets or webs of the character mentioned, once made, are often used in making carpet underlays and mats used for thermal and accoustical insulation in various applications, including motor vehicles such as automobiles, and the like.

Numerous apparatus and methods have been proposed previously for dispensing or strewing resin on workpieces consisting of layers of disconnected randomly disposed fibers. However, these previously proposed apparatus and methods do not provide uniform distribution of the resin on such workpiece and/or provide excessive contamination of the environment, particularly the immediate environment, thereby producing a health and safety hazard.

For example, one proposed apparatus utilizes a fluted roll which is rotated beneath a bottom discharge opening of a hopper filled with resin. A brush roll is rotated against the fluted roll to help remove resin particles which generally lodge in the flutes.

Another type of resin strewer utilizes a resin container which has a bottom opening which discharges resin on an inclined vibratory plate disposed beneath such opening. The plate is vibrated by a suitable vibrating mechanism and the amplitude and frequency of the plate vibration is controlled in an effort to control the flow of resin from such plate.

Still another type of resin strewer uses a cylindrical pipe provided with spaced discharge holes in the lower portion thereof. Resin is moved along the pipe by a conventional feed screw and such screw forces resin through the discharge holes with rotation of the feed screw.

An enclosed material conveying system is also known where a material such as a powder or the like, is moved through an enclosed pipe system arranged in an endless loop utilizing an endless chain which is moved within the pipe system and such chain has chain flights fastened thereto at spaced intervals for dragging the material therealong. A typical system of this type is manufactured and sold by Hapman Division/ PRAB Conveyers, Inc., 6002 East Kilgore Rd., Kalamazoo, Mich. 49003.

SUMMARY

It is a feature of this invention to provide an apparatus for dispensing a powder-like material by gravity which provides substantially uniform distribution of such material with a high rate of consistency yet with minimum contamination of the immediate environment.

Another feature of this invention is to provide an apparatus of the character mentioned particularly adapted for dispensing a powder-like material in a continuous mass production process.

Another feature of this invention is to provide an apparatus of the character mentioned particularly adapted for dispensing a resin, which serves as an adhesive, on a workpiece consisting of a controlled thickness layer of disconnected randomly disposed fibers or fiber lengths which are to be bonded together to define a blanket construction or web useable to provide cushion means or mats providing sound and/or thermal insulation.

Another feature of this invention is to provide an apparatus of the character mentioned comprising a substantially horizontally disposed tubular body having opening means through a bottom portion thereof and conveying means moveable within the body for moving the powder-like material over the opening means enabling gravity flow therethrough and wherein the conveying means comprises a flexible conveying device which is moveable through the tubular body and a plurality of flights fastened in spaced relation on the device for engaging and moving the powder-like material along the tubular body and over the opening means to enable flow therethrough by gravity.

Another feature of this invention is to provide an apparatus of the character mentioned wherein the tubular member is a straight length of pipe having a central longitudinal axis.

Another feature of this invention is to provide an apparatus of the character mentioned in which the opening means comprises a plurality of spaced apart openings through the bottom portion of the tubular body.

Another feature of this invention is to provide an apparatus of the character mentioned in which the opening means comprises a single elongate slot through the bottom portion of the tubular body with the slot being disposed substantially parallel a central longitudinal axis of the body and with the slot being of substantially rectangular outline and having a particularly discharge area.

Another feature of this invention is to provide an apparatus of the character mentioned which comprises means for changing the effective area of the opening means enabling controlled dispensing of the powder-like material therethrough.

Another feature of this invention is to provide an improved method of dispensing a powder-like material by gravity with substantial uniformity and a minimum contamination of the immediate environment.

Therefore, it is an object of this invention to provide an improved apparatus and method having one or more of the novel features set forth above or hereinafter shown or described.

Other details, features, uses, objects, and advantages of this invention will become apparent from the embodiments thereof presented in the following specification, claims and drawings.

BRIEF DESCRIPTION OF THE DRAWINGS

The accompanying drawings show present preferred embodiments of this invention, in which.

DETAILED DESCRIPTION

Figure 1:
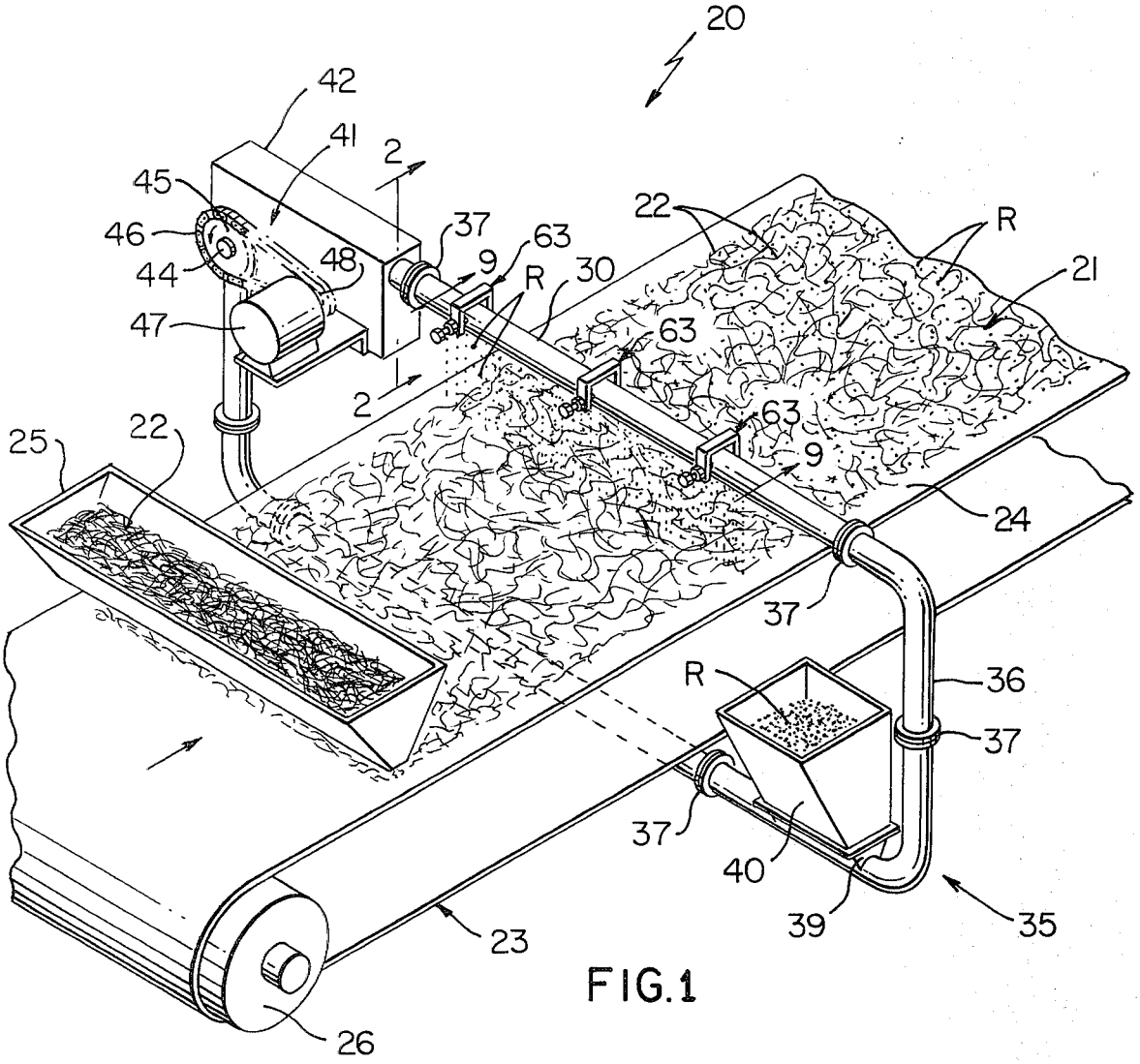
FIG. 1 is a fragmentary perspective view illustrating one exemplary embodiment of the apparatus and method of this invention wherein a powder-like material in the form of a powdered resin is dispensed or strewn in a continuous manner on a moving workpiece, consisting of a layer of random disconnected fibers, with minimum contamination of the immediate environment and with the resin being dispensed in a substantially uniform manner.

Reference is now made to FIG. 1 of the drawings which illustrates one exemplary embodiment of the apparatus and method of this invention for dispensing a powder-like material by gravity feed with such apparatus and method being designated generally by the reference numeral 20 and shown with associated components of a system which is used to process a moving layer of fibers in a continuous manner and as will be described in more detail subsequently. The apparatus and method 20 provide a dispensing action with substantial uniformity yet with minimum contamination of the environment by airborne particles of the powder-like material and as will be readily apparent from the following description. In this example, the apparatus and method 20 are utilized to dispense a powder-like material in the form of a resin which is designated by the reference numeral R and such resin is dispensed in a continuous production process on a layer of fibrous material which is designated generally by the reference numeral 21.

The layer 21 consists of disconnected randomly disposed fibers or fiber lengths 22 which are substantially uniformily distributed on suitable moving means, shown in this example as a movable belt conveyor 23. The belt conveyor 23 is disposed substantially horizontally with a top supporting surface 24 thereof being disposed in a horizontal plane enabling the fibers 22 defining the layer 21 to be distributed in a uniform manner on the surface 24 of the conveyor 23. The fibers 22 may be placed or dispensed on the surface 24 using any suitable means known in the art and in this example of the invention, for simplicity of illustration, and open top container 25 is illustrated and such container is constantly replenished with fibers with flow from a bottom opening in the container being controlled by techniques which are known in the art such as through air-lay or garnetting. The belt conveyor 23 is supported on suitable conveyor rollers 26, with only one of such rollers being shown, and one or more of the conveyor rollers is driven by a belt drive system (not shown) as is known in the art.

Figure 3:
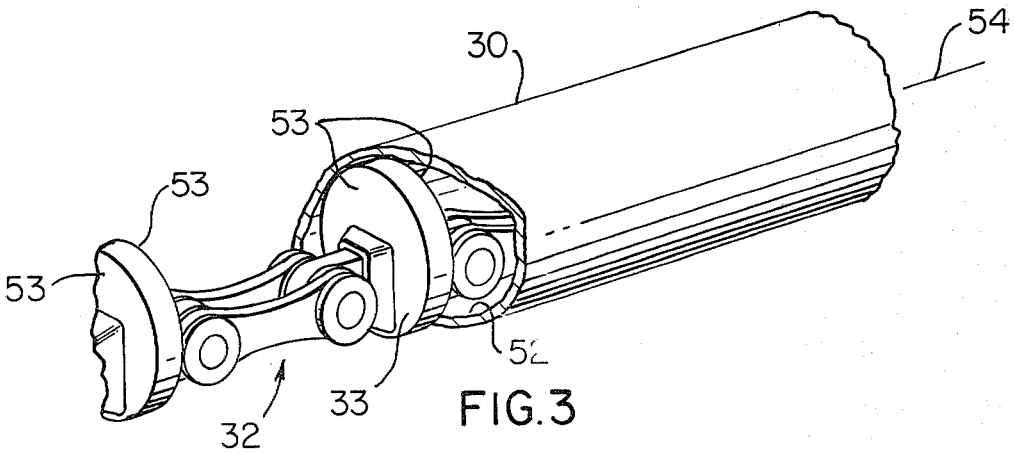
FIG. 3 is a fragmentary perspective view, with a part in cross section, particularly illustrating details of a tubular body in the form of a dispensing pipe of this invention into which a powder-like material is conveyed and dispensed from the lower portion thereof by a moving flexible conveying device or chain having flights or disc-like members suitably fastened thereto in spaced relation.
Figure 4:
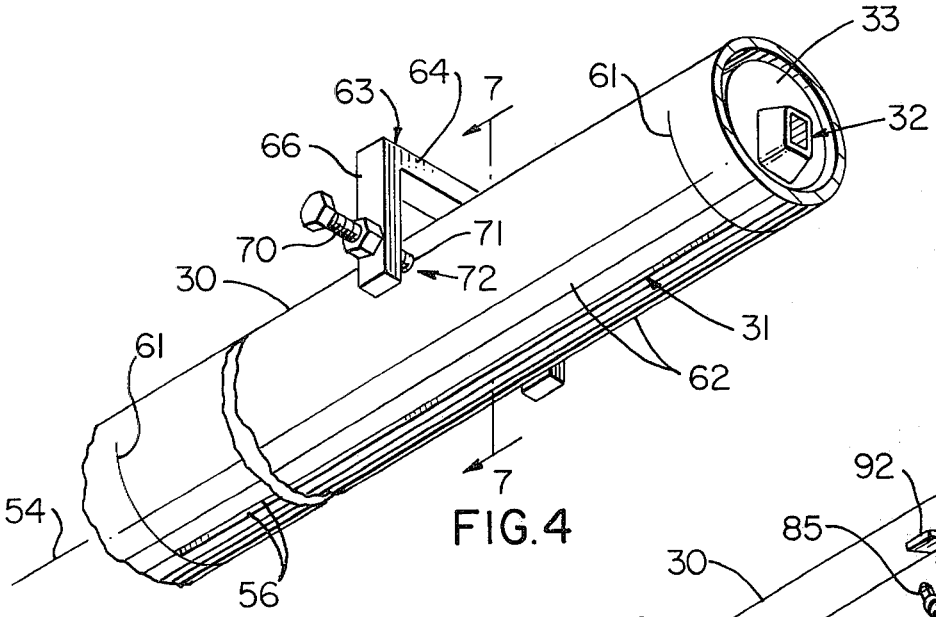
FIG. 4 is a fragmentary perspective view particularly illustrating opening means, in the form of a single elongate slot, in the bottom portion of the dispensing pipe and through which powder-like material is dispensed in accordance with the teachings of this invention and also illustrating a typical clamping device used for urging opposed edges of the slot together to change its effective area and thereby control the flow of powder-like material therethrough.

The apparatus 20 comprises a substantially horizontally disposed tubular body shown in this example as a pipe 30 which has opening means designated generally by the reference numeral 31 in FIG. 4 and shown in the form of an elongate slot 31. The apparatus 20 also has conveying means comprising a flexible conveying device 32 (FIG. 3) which is moveable through the tubular body or pipe 30 and has a plurality of flights 33 fastened thereon in spaced relation and provided for the purpose of engaging and moving the powder-like material or resin R along the pipe 30 and over the slot 31 enabling dispensing therethrough with substantial uniformity. As the resin R is moved over the slot 31 it is free to fall therethrough by gravity and the uniform dispensing action (or resin strewing) is illustrated at 38 in FIG. 9 by the substantially uniform placement of dots representing particles of resin R between the pipe 30 and the layer 21 of fibers 22. The uniform dispensing of resin particles R is further highlighted at 34 in FIG. 10 which shows substantially uniform dispersal of individual particles over a representative area of the layer 21.

The apparatus 20 comprises a resin supply system for the powder-like material or resin R and such supply system is designated generally by the reference numeral 35. The supply system 35 comprises a conduit system 36 which is operatively connected to opposite ends of the pipe 30 by suitable connection flanges 37; and, other flanges, also designated by the reference numeral 37, are provided to connect the other component portions of the conduit system together.

The supply system also comprises a resin reservoir 40 which is operatively connected to the conduit system and in this example the reservoir 40 is shown as a simple open-top reservoir having a bottom outlet 39 in flow communication with the conduit system 36. The reservoir 40 may be readily filled with resin through the open top thereof.

As mentioned earlier, the conveying means for moving the powdered resin R over the slot 31 consists of the flexible conveying device 32 having flights 33 attached thereto. The device 32 with its flights extends through the pipe 30 and conduit system 36 in an endless path defined thereby and the device 32 of this example is an endless flexible sprocket chain. The conveying means also includes a drive 41 for driving the sprocket chain 32 as will now be explained.

The drive 41 comprises a housing structure 42 which is suitably supported for receipt of the chain 32 therethrough. The drive 41 comprises a sprocket wheel 43 disposed within the housing 42 and fixed on a rotatable shaft 44 which is rotatably supported by the housing 42 and the shaft has an end which extends through a wall of the housing 42 and has another sprocket wheel 45 suitable fixed thereto. The sprocket wheel 45 has a sprocket chain 46 operatively disposed therearound and the chain 46 is driven by an electric drive motor 47 through a cooperating sprocket 48 which is suitably fixed to the drive shaft of the electric drive motor 47. With this arrangement the drive motor drives the endless chain 32 through the use of sprocket wheels 48, 45 and 43 and chain 46.

Figure 9:
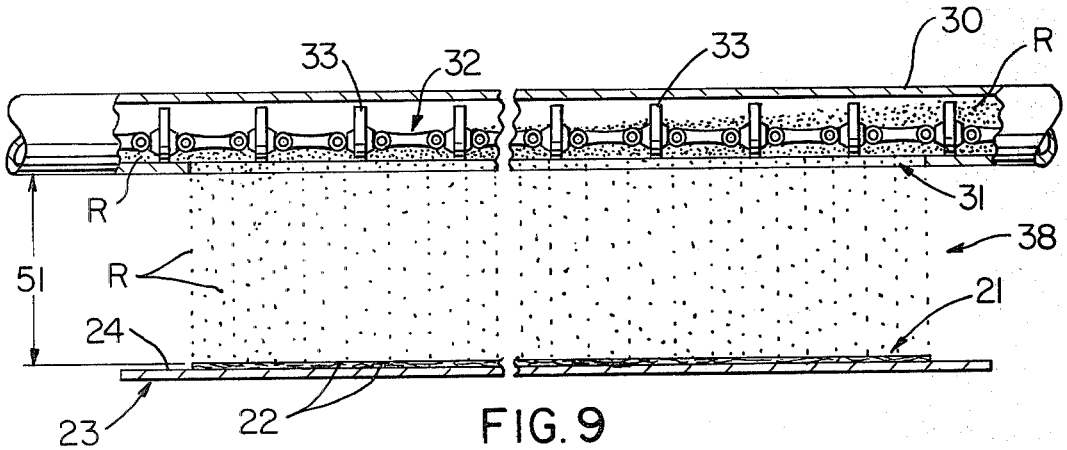
FIG. 9 is a view illustrating the flow by gravity of powder-like material from the dispensing slot of the dispensing pipe of this invention onto a layer of fibers moving on a conveyor and particularly highlighting the uniform manner in which the powder-like material is dispensed.
Figure 10:
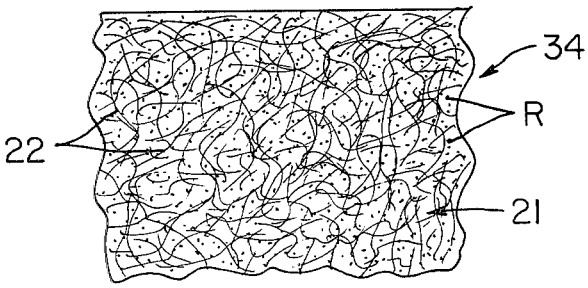
FIG. 10 is a fragmentary plan view of the layer of fibers after dispensing the powder-like material thereon with the view further highlighting the uniform manner in which such powder-like material is dispensed on the layer of fibers.

From the above description it is seen that the apparatus 20 may be utilized to dispense resin R on the fibrous layer 21 with minimum contamination of the environment because all portions of the resin strewing or dispensing system are enclosed except at the location where the resin R is being dispensed; and, at this dispensing location the resin is merely falling by gravity onto the fibrous layer 21 without agitation and without the creation of airborne clouds of resin particles R. To further assure that resin particles do not become airborne, the distance 51 (FIG. 9) between the slot 31 and the top surface of the fibrous mat 21 may be precisely controlled and kept as small as possible and generally of the order of several inches. In FIG. 9, a substantial distance 51 is illustrated between the bottom portion of the pipe 30, with its slot 31, and the top surface of the fibrous mat 21 and this has been done to highlight that the distribution of resin R is achieved with uniformity as previously explained.

Figure 2:
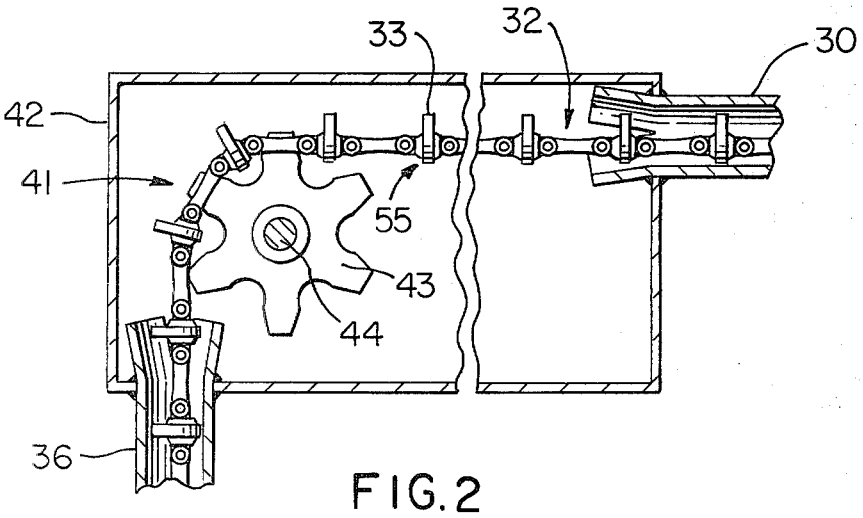
FIG. 2 is a fragmentary view with parts in cross section, parts in elevation, and parts broken away taken essentially on the line 2—2 of FIG. 1.

Referring now to FIG. 3, it is seen that the pipe 30 has a right circular cylindrical passage 52 therethrough and the flights 33 are in the form of flat circular discs. Each disc 33 has at least one planar surface and in this example each disc has opposed planar surfaces 53. Each disc 33 is attached to the flexible endless chain 32 with its planar surfaces 53 disposed substantially perpendicular to a central longitudinal axis 54 of the pipe 30. The discs 33 are fastened to the endless chain 32 at equally spaced intervals and each disc has its lower central portion fastened to the chain 32 and as shown at 55 in FIG. 2. By attaching the lower central portion of each disc 33 to the flexible chain 32, a free movement of the chain 32 is assured without binding tendancies during chain and flight movement.

Figure 7:
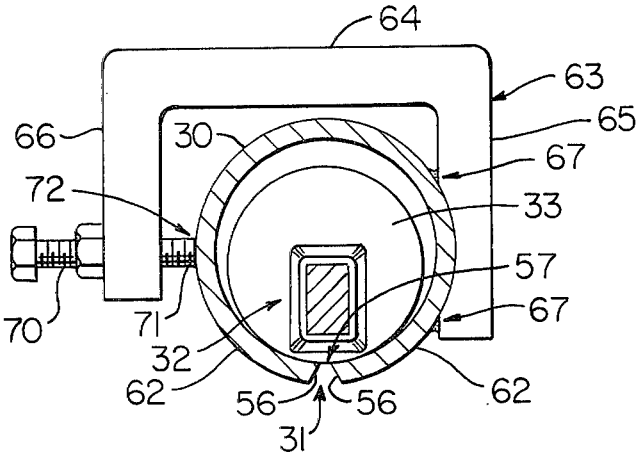
FIG. 7 is a view taken essentially on the line 7—7 of FIG. 4 showing details of the clamp device of FIG. 4.

The opening means 31 in the bottom portion of pipe 30 may be single opening as shown in FIGS. 4 and 7 or a plurality of openings as will be described later. The single opening is preferably an elongate slot which is also designated by the reference numeral 31. The slot 31 is disposed substantially parallel to the central longitudinal axis 54 of the pipe 30 and such slot 31 is comprised of diverging or outwardly flaring wall portions 56 of the pipe 30 along its larger dimension which assure dispensing of resin R by gravity with minimum likelihood of clogging. The slot 31 of this example has a substantially rectangular effective discharge area which is indicated at 57.

The apparatus 20 has means for changing the discharge area 57 enabling controlled dispensing of the resin R through the slot 31. The means for changing the discharge area of the slot may be in the form of a means which, in essence, distorts the pipe 30 to change the discharge area or such means may comprise a control plate, which is designated by the reference numeral 60 in FIG. 6, for providing controlled blockage of a slot 31 of fixed size and each of these means will be described subsequently.

The pipe 30 may be made of any suitable material such as a high-strength resilient plastic or metal. In this disclosure the pipe 30 is in the form of a metal pipe and such pipe 30 has a pair of slits 61 extending through the lower portion of the pipe in spaced relation and perpendicular to the axis 54. The slits 61 coincide with opposite ends of the slot 31 and such slits extend through the wall of the pipe 30 and each defines a substantially semi-circular gap or cut which extends approximately to a diametral plane through the pipe. The slot 31 and slits 61 on opposite sides thereof define what will be referred to as a pair of substantially quarter-cylindrical portions of the pipe 30 on opposite sides of the slot 31 and each quarter-cylindrical portion will be designated by the same reference numeral 62. This reference of quarter-cylindrical portion is intended to describe that each portion of the wall of the pipe 30 on one side of the slot 31 between slits 61 extends through an arc of roughly 90° which is one quarter of the 360° arc of the entire pipe circumference.

The apparatus 20 also has means for urging the portions 62 toward each other to enable changing of the effective discharge area 57 and thereby enable controlled dispensing of the powder-like material or resin R through the slot 31. The urging means may be any suitable means known in the art and in this example the urging means comprises at least one C-clamp (FIG. 7) and preferably comprises a plurality of C-clamps (three in this disclosure) each designated by the same reference numeral 63.

Each C-clamp 63 has a bight 64 and a pair of legs 65 and 66 extending from opposite ends of the bight and the leg 65 of this example is longer than the leg 66. The leg 65 is fixed to one of the portions 62 of the pipe 30 as by welding and as shown at 67 while the bight 64 extends across the pipe 30 on the side of the pipe opposite from the slot 31. The leg 66 of the C-clamp 63 has a threaded bolt 70 suitably threaded through a threaded opening therein and the bolt 70 has an end 71 which engages the opposite portion 62 of pipe 30 as shown at 72.

The C-clamps 63 are used to provide controlled urging of one portion 62 toward the other by threading bolts 70 so as to cause ends 71 to urge the adjoining portion 62 toward the other portion and during this urging action it will be appreciated that the area 57 of the slot 31 is effectively reduced. Once the portions 62 have been urged or deflected from their normal positions toward each other, it is a simple matter to increase the area of the slot 31 merely by rotating each of the bolts 70 in an opposite direction thereby allowing the normal resiliency of the pipe 30 to restore portions 62 toward their normal positions.

Figure 8:
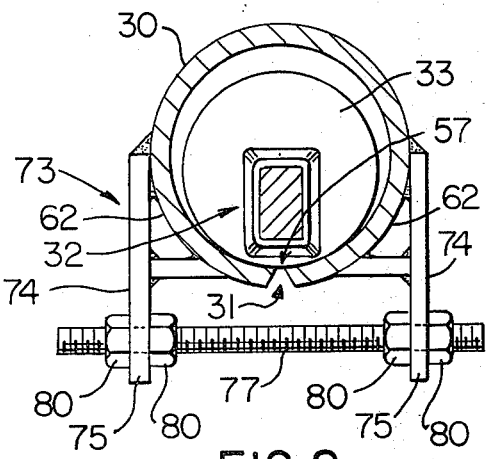
FIG. 8 is a view similar to FIG. 7 illustrating another exemplary embodiment of a clamping device which may be used in lieu of the clamping device of FIG. 4.

A modification of the means for changing the area of the slot 31 is illustrated in FIG. 8 where clamping means designated generally by the reference numeral 73 is provided. The clamping means 73 comprises a pair of clamping structures each designated by the same reference numeral 74 and each clamping structure 74 is fixed to an associated pipe portion 62, preferably by welding. Each clamping structure 74 has a leg 75 extending therefrom and each leg 75 has a plain or unthreaded opening therethrough which receives a treaded rod 77. The rod 77 has a pair of threaded nuts 80 which are adapted to be disposed on opposite sides of an associated leg 75. The clamping means 73 with its pair of clamping structures make possible both a decrease or an increase in the size of the slot 31. For example, it is a simple matter to thread the nuts 80 of one leg 75 toward the nuts 80 of another leg 75 and thereby move the portions 62 toward each other and reduce the effective area 57 of the slot 31. Conversely, the nuts 80 of one leg 75 may be threaded away from the nuts 80 of the opposite leg to increase the effective area of the slot 31. In each instance the amount of movement is well within the elastic limit of the pipe 30 so that regardless of whether portions 62 are moved to decrease or increase the area of the slot 31, the tendancy is for the portions 62 to return to their original unstressed configuration which define the original size of the slot 31.

Figure 5:
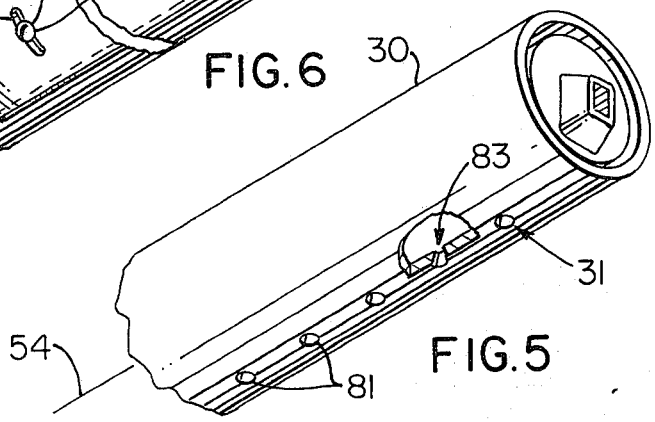
FIG. 5 is a view similar to the right-hand portion of FIG. 4 particularly illustrating opening means in the dispensing pipe in the form of a plurality of spaced apart openings in the bottom portion of such pipe for the purpose of dispensing powder-like material therethrough.

The above description has proceeded with the means enabling gravity flow of the powder-like material or resin R being defined as opening means in the form of a single elongate slot 31. However, it will be appreciated that such opening means may consist of a plurality of spaced apart circular openings each designated by the same reference numeral 81 and as shown in FIG. 5. The openings 81 extend in a rectilinear path along the bottom portion of the pipe 30 with such path being substantially parallel to the central longitudinal axis 54 of such pipe. To assure that there is a minimum tendency for the openings 81 to clog, each opening 81 has an effective area 83 at its base thereof and each opening 81 flares outwardly through the pipe wall from the inside surface of the pipe to the outside surface thereof.

Figure 6:
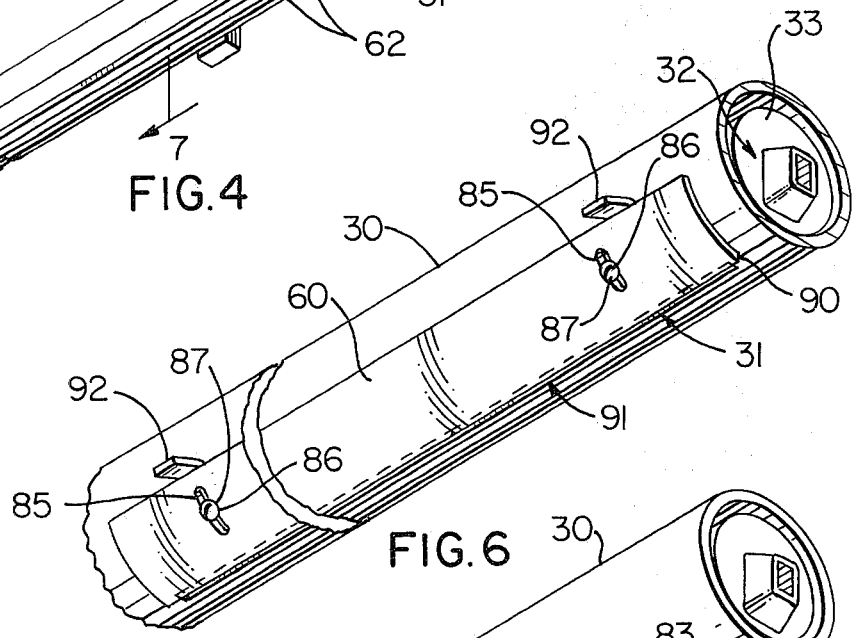
FIG. 6 is a fragmentary perspective view illustrating another type of means for changing the effective area of the elongate slot of FIG. 4 utilizing a control plate.

The apparatus 20 has means for changing the effective discharge area of the opening means or slot 31 by pipe stressing or temporary distortion as described above. However, alternatively such means may be in the form of a plate 60 as previously mentioned. Such a plate 60 is shown in FIG. 6 in operative association with the elongate slot 31 and the plate is an arcuate plate member which has a pair of elongate fastening openings 85 extending therethrough. A threaded metal screw 86 extends through each opening 85 and is threadedly received within an associated blind threaded opening (not shown) in the pipe 30. Each screw 86 has a head 87 which is larger than the width of its elongated opening 85.

The plate 60 serves as an adjustable gate which is easily moved by loosening the metal screws 86 and the sliding the plate 60 circumferentially around the pipe 30 using the elongated openings 85. The plate has a straight lower edge 90 which lies parallel to the longitudinal axis of the elongated slot 31 and once this edge partially covers the slot 31 it serves to restrict the flow area thereof (as shown at 91) depending on the amount of slot coverage. The plate 60 may be provided with a pair of stops 92 to limit the extent of movement in one direction away from the slot 31, as desired. As mentioned earlier, the plate 60 is an arcuate plate, i.e., the plate 60 has arcuate inside and outside surfaces which correspond to the outside surface of the pipe 30 which it engages.

The plate 60, or a similar plate, may be used to control the opening means 31 in the form of slot 31 as described above or to control opening means in the form of the plurality of spaced openings 81 of the type illustrated in FIG. 5. The plate 60 would be operated in a similar manner as described above whether used over a slot or over a plurality of openings.

The pipe 30, remainder of the conduit system 36, reservoir 40, and other components of the system may be made using materials known in the art. As indicated previously, the pipe 30 may be made of either metallic or non-metallic material. The flights or discs 30 are preferably made of antifriction non-metallic material. One example of an antifriction non-metallic material which may be used is a hard synthetic plastic material, such as polyethylene.

The pipe 30 and associated conduit system need not necessarily be circular cross-sectional configuration, but may be of any desired cross-sectional configuration. Similarly, the flights or discs 33 would be constructed and arranged so as to conform to the inside configuration of their pipe 30 and conduit system.

Reference has been made throughout this disclosure to the control of the amount of resin R dispensed by gravity through the opening means 31, whether in the form of a slot or a plurality of openings, by controlling the area of the opening means. The main control is this control of the area; however, the speed at which the chain 32 is driven in its endless path may also be controlled to change the total amount of resin distributed over any given time period with continuous movement of a fiber layer 21 thereunder. This change of speed of the conveyor chain 32 is achieved simply by providing a variable speed control on the electric motor 47 and using this control to change the motor and chain speed.

In this disclosure of the invention the flexible conveying device has been illustrated and described as a flexible sprocket chain; however, it will be appreciated that this flexible device may be any other flexible device known in the art, such as inextensible cable, or the like, which is capable of being driven in an endless path and in an enclosed conduit or pipe system.

The amount of resin dispensed or strewn utilizing the apparatus and method 20 to provide a dispensing action by gravity is dependent not only on the size of the dispensing opening but also on the size range of the individual particles being dispensed. The resin R, or any other powder-like material, which is to be dispensed utilizing the apparatus and method of this invention will be correlated in particle size with its dispensing opening means so as to provide a precise and controlled dispensing action.

In this disclosure the powder-like material or resin R is shown being dispensed on a fibrous layer 21 which is to be processed further. It will be appreciated that this layer may be further processed, as is known in the art, by compacting, heating, cooling, etc., to bind the individual fibers 22 and define a unitary web. Such unitary web may be used to define fibrous carpet underlays, upholstery pads, acoustical pads, thermally insulating pads, and the like.

While present exemplary embodiments of this invention, and methods of practicing the same, have been illustrated and described, it will be recognized that this invention may be otherwise variously embodied and practiced within the scope of the following claims.

What is claimed is:

1. In an apparatus for dispensing a powder-like material by gravity on a workpiece with a minimum contamination of the immediate environment; said apparatus comprising a substantially horizontally disposed tubular body having a single elongate slot through a bottom portion thereof; said slot extending through said tubular body substantially perpendicular to its central longitudinal axis; conveying means movable within said body for moving said powder-like material over said slot enabling gravity flow therethrough; said conveying means comprising a flexible conveying device which is movable through said tubular body and a plurality of flights fastened in spaced relation on said device for engaging and moving said powder-like material along said tubular body and over said slot enabling said dispensing therethrough with substantial uniformity; said slot having an elongate dimension disposed substantially parallel to said central longitudinal axis and having a substantially rectangular effective discharge area; the improvement in which said tubular body is defined as a pipe made of a resilient material and has said slot extending through said bottom portion thereof and further comprising means for changing said discharge area enabling controlled dispensing of said powder-like material through said slot; said means for changing said discharge area comprising, a pair of slits extending through the lower portion of said pipe in spaced parallel relation perpendicular to said axis, said slits coinciding with opposite ends of said slot and extending approximately to a diametral plane through said pipe, said slot and slits defining a pair of substantially quarter-cylindrical portions of said pipe on opposite sides of said slot, and means for urging at least one of said quarter-cylindrical portions relative to the other by applying urging forces thereagainst within the elastic limit of said pipe and thus provide temporary distortion thereof to enable changing said effective discharge area and thereby enable controlled dispensing of said powder-like material through said slot.

2. An apparatus as set forth in claim 1 in which said urging means comprises clamping means.

3. An apparatus as set forth in claim 2 in which said clamping means comprises at least one C-type clamp having a bight and a pair of legs extending from said bight wherein one of said legs engages one of said portions, said bight extends across said pipe on the side thereof opposite from said slot, and the other of said legs has a threaded member threaded therethrough, said threaded member having an end engaging the other of said portions to enable urging same toward said one portion.

4. An apparatus as set forth in claim 2 in which said clamping means comprises a pair of clamping structures each fixed to an associated one of said quarter-cylindrical portions and a threaded assembly operatively connected between said structures for urging the structures and the associated quarter-cylindrical portions attached thereto toward and away from each other to change said effective discharge area.

5. An apparatus as set forth in claim 1 in which said flights are flat discs each having at least one planar surface, each of said discs being attached to said device with said planar surfaces disposed substantially perpendicular to said central longitudinal axis.

6. An apparatus as set forth in claim 5 in which said discs are substantially circular discs fastened at equally spaced intervals to said device and each of said discs has its lower central portion fastened to said conveying device.

7. An apparatus as set forth in claim 6 in which said conveying device is a sprocket chain.

8. An apparatus as set forth in claim 7 in which each of said discs is made of an antifriction synthetic plastic material.

9. An apparatus as set forth in claim 1 in which said slot extends radially outwardly through the wall thickness of said pipe in an outwardly flaring manner.

* * * * *